US006799444B1

(12) United States Patent
Wang

(10) Patent No.: US 6,799,444 B1
(45) Date of Patent: Oct. 5, 2004

(54) CIRCULAR KNITTING MACHINE

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 10/759,579

(22) Filed: Jan. 20, 2004

(51) Int. Cl.[7] ..... D04B 15/32
(52) U.S. Cl. ..... 66/108 R; 66/107
(58) Field of Search ..... 66/8, 57, 78, 90, 66/104, 107, 108 R, 108 A

(56) References Cited

U.S. PATENT DOCUMENTS 3,735,812 A * 5/1973 Flavell et al. ..... 66/104
4,180,993 A * 1/1980 Philip ..... 66/107
4,693,092 A * 9/1987 Plath ..... 66/55
5,279,133 A * 1/1994 Plath ..... 66/9 R

* cited by examiner

*Primary Examiner*—Danny Worrell
(74) *Attorney, Agent, or Firm*—Birch, Stewart, Kolasch & Birch, LLP

(57) ABSTRACT

An improved circular knitting machine aims to provide an improved structure and installation for cams. It includes a saddle plate forming an angle to the horizontal surface with the cams mounting thereon in an inclined manner, and a sinker drum surrounded by the saddle plate. The sinker drum has an inclined surface formed in a continuous circular ring in the shape of a conical shallow tray so that the sinker drum has a concave surface. The sinker drum has sinker troughs formed thereon for housing sinkers in an inclined manner. The cam has one end fastened to the saddle plate in an inclined manner and the other end forming a convex surface to be in contact with the concave surface. The cam has a driving path formed on the bottom side thereof to allow the sinkers to be movable therein. The sinker drum may be rotated to drive the sinkers to move smoothly in the cam.

2 Claims, 8 Drawing Sheets

CIRCULAR KNITTING MACHINE

FIELD OF THE INVENTION

The present invention relates to an improved circular knitting machine that has a saddle plate with matching cams and sinkers assembled thereon in an inclined manner, and a sinker drum with a concave surface forming a continuous circular ring in the shape of a conical shallow tray to allow the cams and the sinker drum to form a concave and convex surface contact thereby to achieve a smooth match between sinkers and cams.

BACKGROUND OF THE INVENTION

Conventional circular knitting machines generally include sinkers driven by a cam. The cam has a driving path to move the sinkers to and fro to perform a knitting operation.

The sinker is engaged with a preset driving path as shown in FIG. 1A. During a knitting operation, the lug 62 of the sinker 61 is engaged with the driving path 64 of the cam 63 so that the sinker 61 is moved according to the driving path 64 to perform the knitting operation. The cam 63 is mounted horizontally on the machine deck. The sinker 61 is also mounted horizontally.

Referring to FIGS. 1A and 2, the sinker 61 is located on a sinker drum 60 which rotates at a high speed during knitting operation, and the sinker 61 is driven by the driving path 64 to move reciprocally to and fro rapidly. When the sinker drum 60 rotates at high speed, the sinker 61 is forced outwards due to a centrifugal force, but is retained by the driving path 64 of the cam 63. Meanwhile the lug 62 moves along the driving path 64. The centrifugal force generates a great force on the sinker 61 (indicated by an arrow in FIG. 2). As a result, the lug 62 does not move as smoothly as desired along the driving path 64. The contact surface 66 and contact angle 67 between the driving path 64 and the lug 62 form many stress concentration points. The continuous centrifugal force creates severe friction and wear. As a result, the lifetime of the sinker 61 and the cam 63 significantly decreases.

Moreover, as shown in FIG. 1B the cam 63 is mounted horizontally on the machine deck and the sinker 61 also is mounted horizontally. But the sinker drum 60 is a circular barrel with a plurality of cams 63 mounted thereon adjacent to one another in an annular fashion. There is a gap 65 formed between two neighboring and horizontal cams 63. This resulting connection is not continuous between cams 63. Hence during high speed rotation, interference or interruption can occur with the to and fro reciprocal movements of the sinker 61.

SUMMARY OF THE INVENTION

Therefore the object of the invention is to provide an improved circular knitting machine that has a saddle plate with inclined holding surfaces and a sinker drum with an inclined surface so that the matching cams and sinkers are also coupled in an inclined manner. The cams and the sinker drum form a concave and convex arched contact surface so that a gap is less likely to occur. As a result, when the sinker drum rotates, the sinker may be moved along the driving path more smoothly without interference or interruption.

The driving path provided in the invention can also reduce the centrifugal force of the sinker and prevent the lug from hitting the cam. Therefore, the service life of the sinker and cam may increase.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1A:
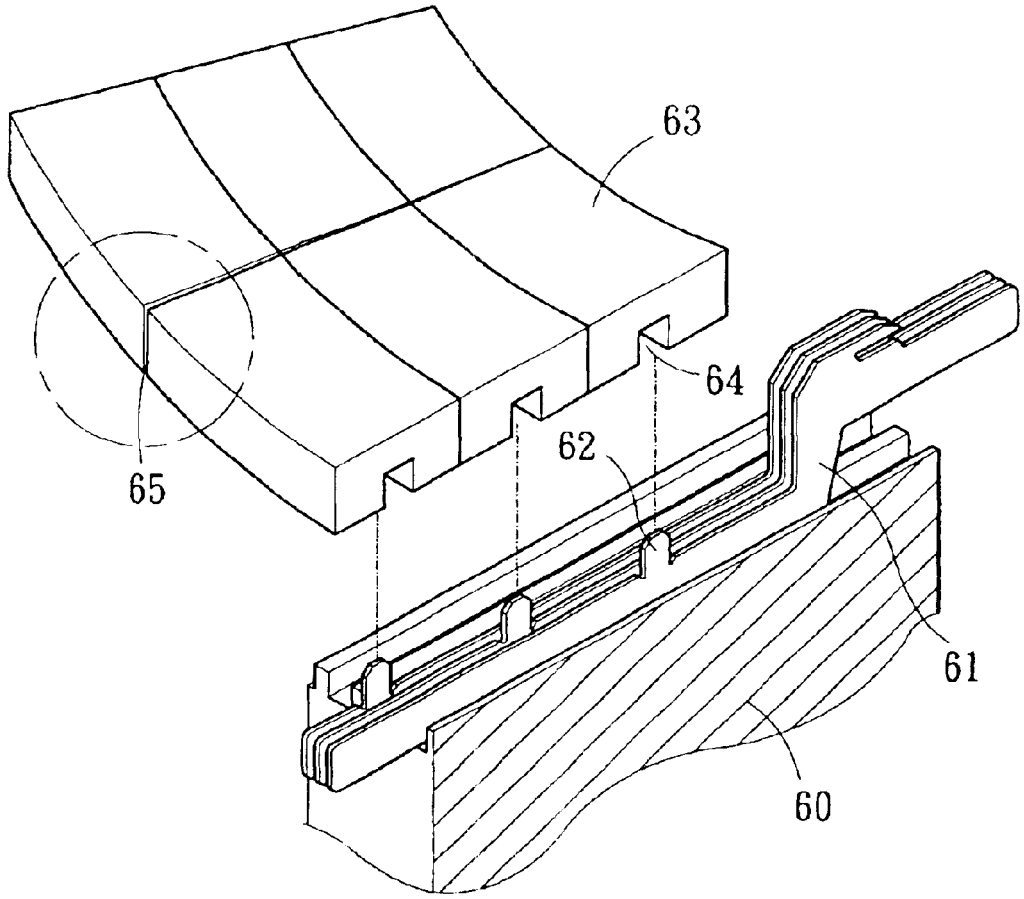
Fig.1A PRIOR ART
FIG. 1A is a perspective view of conventional cams and sinkers mounted in a horizontal manner.
Figure 1B:
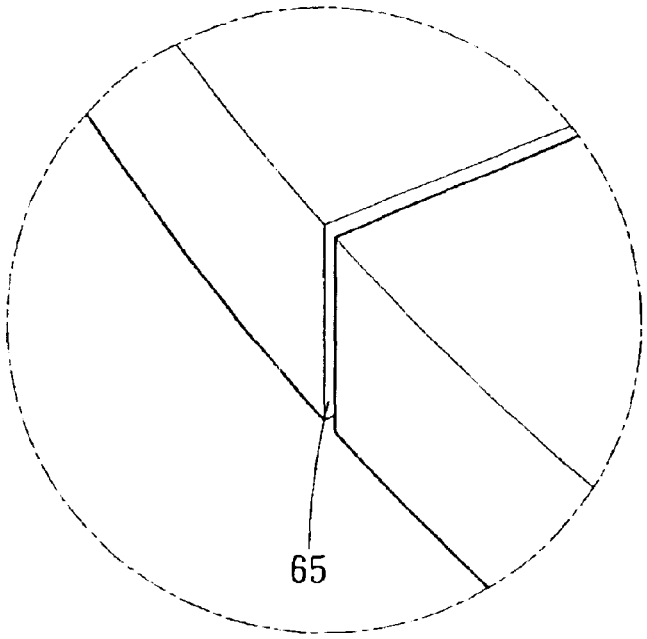
Fig.1B PRIOR ART
FIG. 1B is a fragmentary enlarged schematic view according to FIG. 1A.
Figure 2:
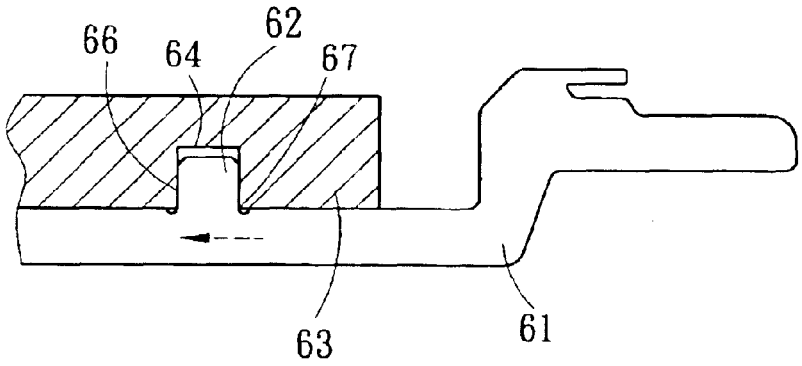
Fig.2 PRIOR ART
FIG. 2 is a schematic view of a conventional cam and sinker in a coupled condition.
Figure 3A:
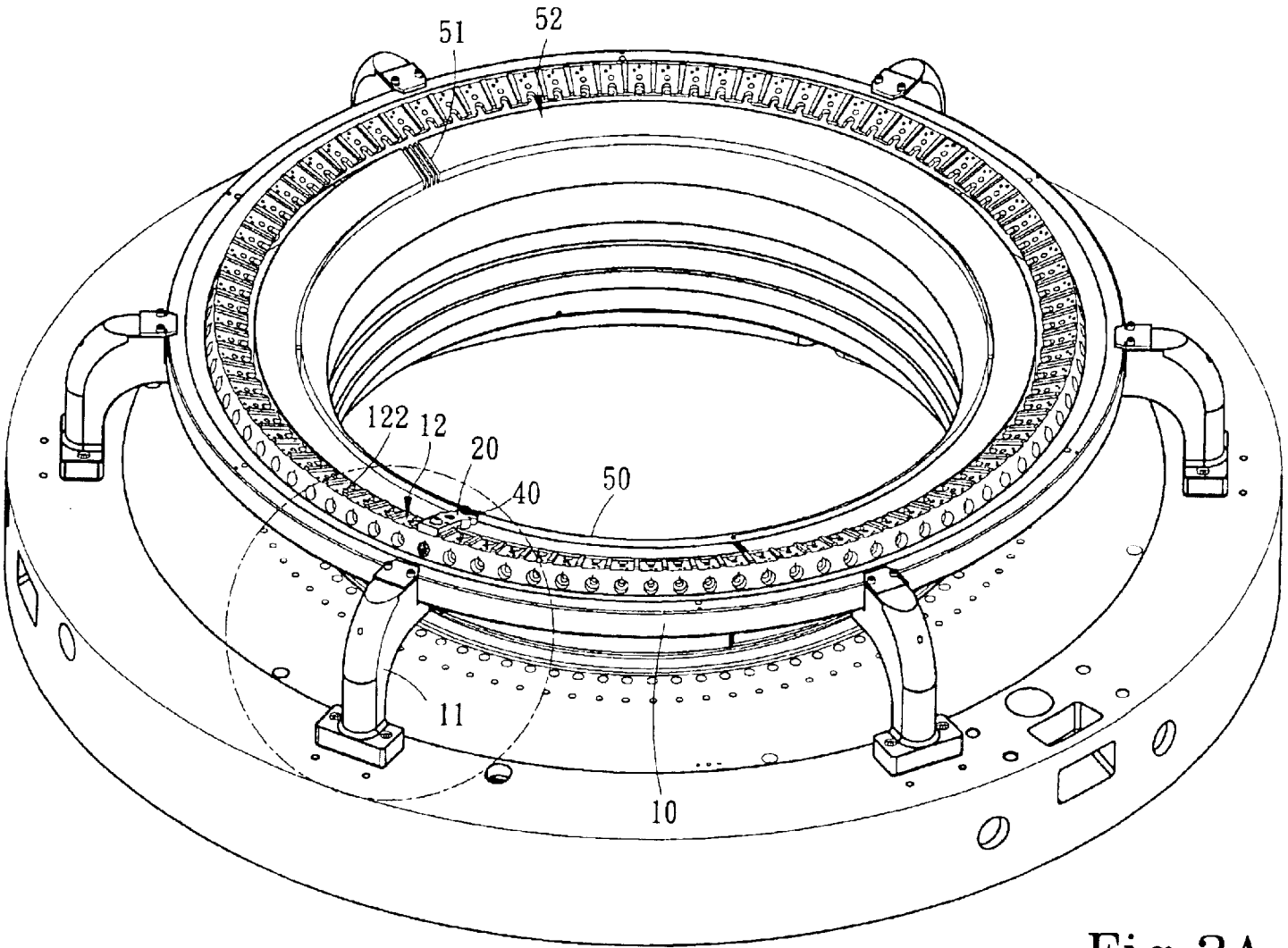
FIG. 3A is a perspective view of the invention.
Figure 3B:
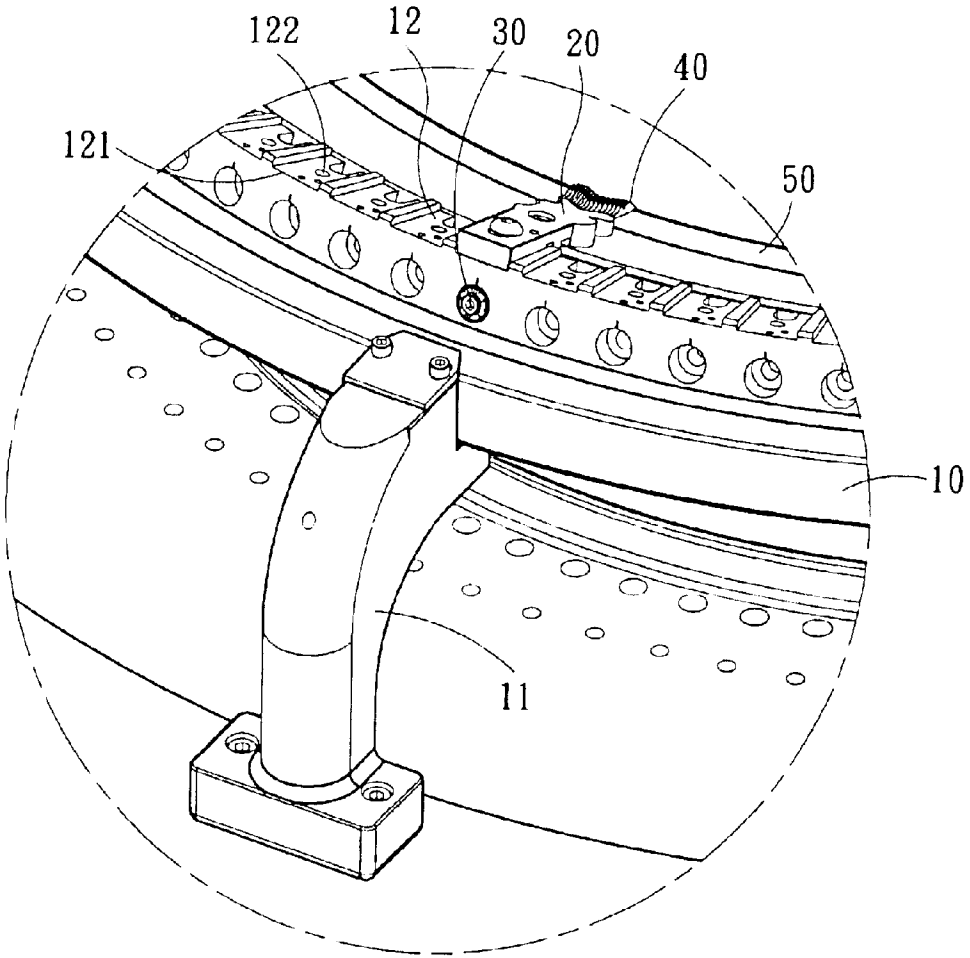
FIG. 3B is a fragmentary enlarged schematic view according to FIG. 3A.
Figure 4:
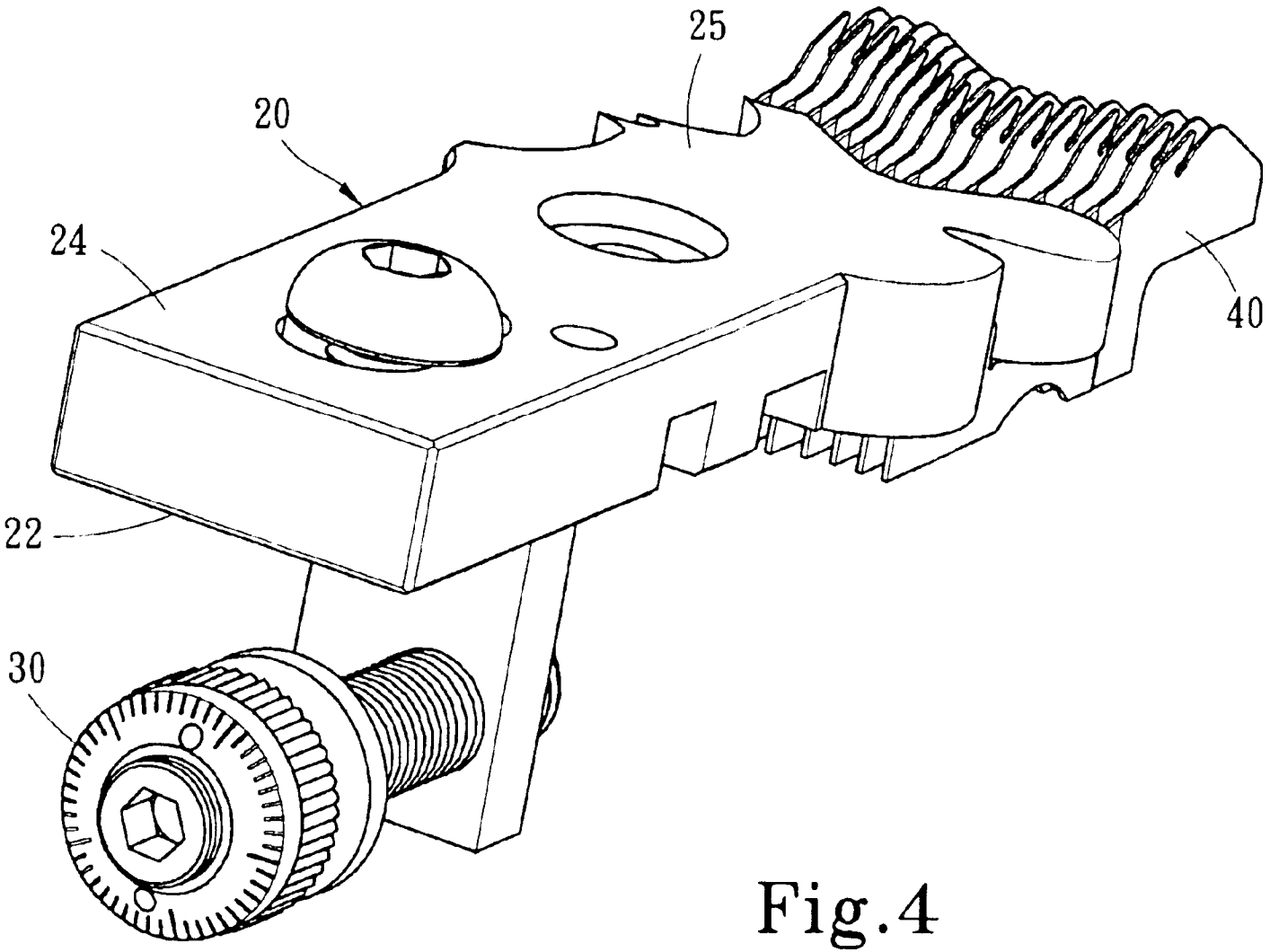
FIG. 4 is a perspective view of a cam and a sinker of the invention in a coupled condition.
Figure 5:
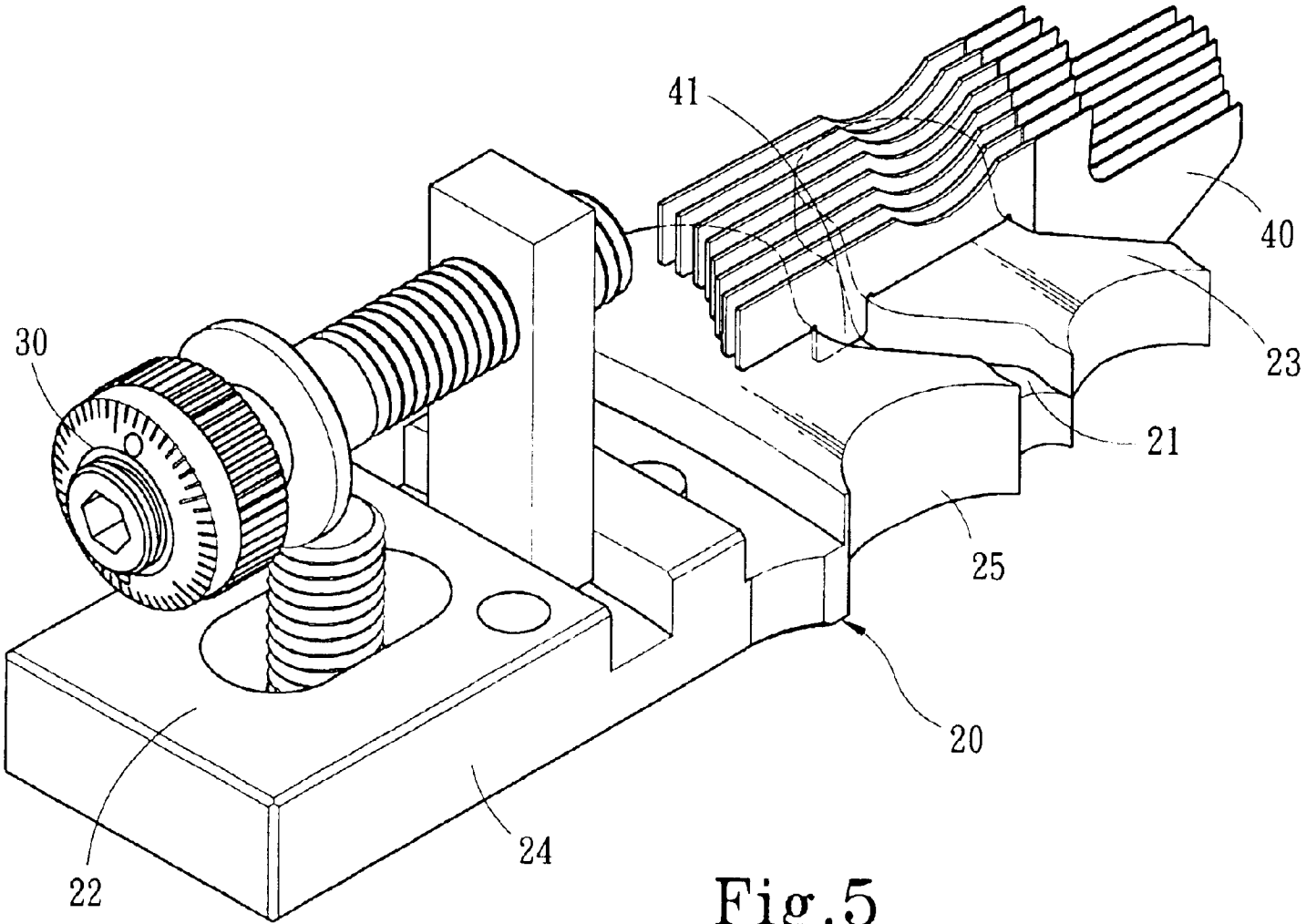
FIG. 5 is a perspective view of the cam and the sinker according to FIG. 4 in an inverse condition.
Figure 6:
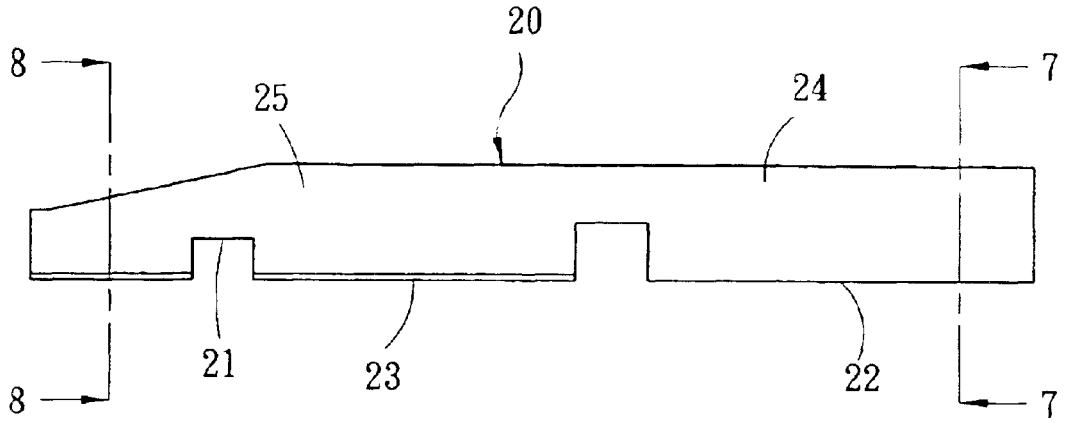
FIG. 6 is a side view of a sinker of the invention.
Figure 7:
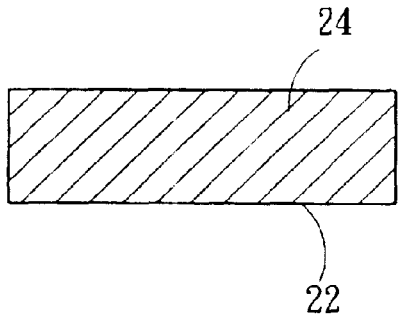
FIG. 7 is a cross section taken on line 7—7 in FIG. 6.

Please referring to FIG. 3A, the improved circular knitting machine according to the invention includes:

- a sinker drum 50 located on an inner ring of the annular knitting section of a knitting machine. It is formed in the shape of a conical shallow tray with an inner surface formed in a small concave surface 52 (the concave surface is formed in a fined fashion and recognizable only by viewing the entire annular ring). The perimeter of the sinker drum 50 has sinker troughs 51 formed thereon in an equally spaced manner for holding sinkers 40 therein. The sinker drum 40 rotates at high speed during knitting operation;
- a saddle plate 10 (referring to FIG. 3B) which is formed in an inclined manner and supported by a plurality of bracing brackets 11 on the outer perimeter for mounting securely on the machine deck of the circular knitting machine. The saddle plate 10 has an inner perimeter forming a plurality of holding surfaces 12 in an equally spaced manner. Each of the holding surfaces 12 is formed in an inclined manner and forms an included angle with the horizontal surface so that the entire saddle plate 10 also is inclined. The holding surface 12 has a screw hole 122 which is also formed in an inclined manner and the inclination is alterable according to the change of the included angle;
- a cam 20 (referring to FIGS. 4 and 5) which has a fastening section 24 on one end and a contact section 25 on another end. The fastening section 24 is fastened to the holding section 12 in an inclined manner through the screw hole 122. There is an adjusting means 30 located on a lower side of the fastening section 24 to adjust the position of the cam 20. The contact section 25 has an irregular and curved driving path 21 formed on a lower side (depending on installation condition). The cam 20 is installed on each holding surface 12 of the saddle plate 10 and forms a circular array with other cams along the saddle plate 10. The fastening section 24 has a contact plane 22 in contact with the holding surface 12 (referring to FIGS. 6 and 7).

Figure 8:
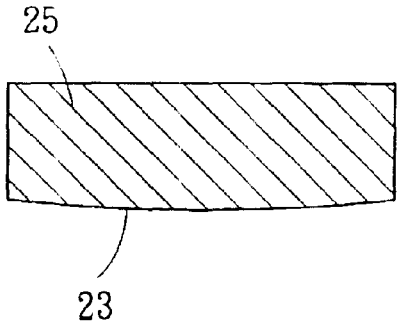
FIG. 8 is a cross section taken on line 8—8 in FIG. 6.

The contact section 25 that has the driving path 21 formed thereon has a fine convex surface 23 in contact with the concave surface 52 of the conical shallow tray of the sinker drum 50 (referring to FIGS. 6 and 8) so that the convex surface 23 and the concave surface 52 form a close concave and convex contact therefore the gap between every two neighboring cams 20 may be minimized or eliminated. Thereby when the sinker drum 50 rotates and the sinker 40 is moved in the driving path 21, interference or interruption on the sinker 40 may be minimized for a smooth operation.

The sinker 40 has a lug 41 on one end that can slide along the driving path 21 of the cam 20, and the other end wedged in the sinker trough 51 of the sinker drum 50. The sinker 40 is movable because of the lug 41 driven by the driving path 21. As the cam 20 is inclined, the sinker 40 also is inclined at an angle.

Figure 9:
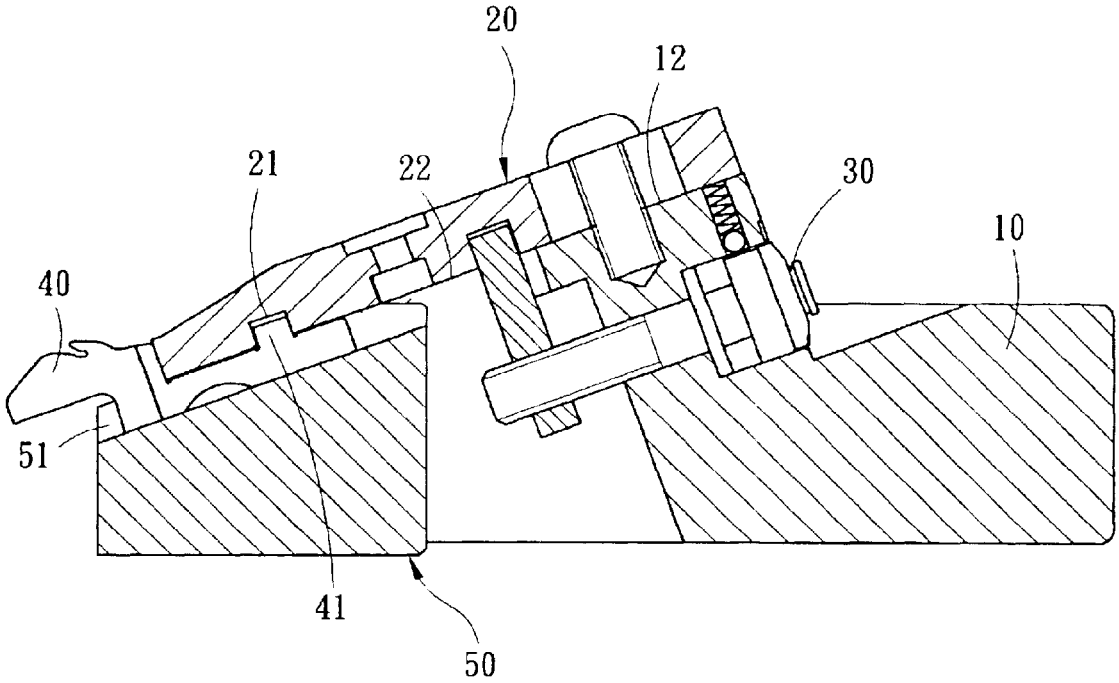
FIG. 9 is a side view of the invention showing the cam mounted in an inclined manner
Figure 10:
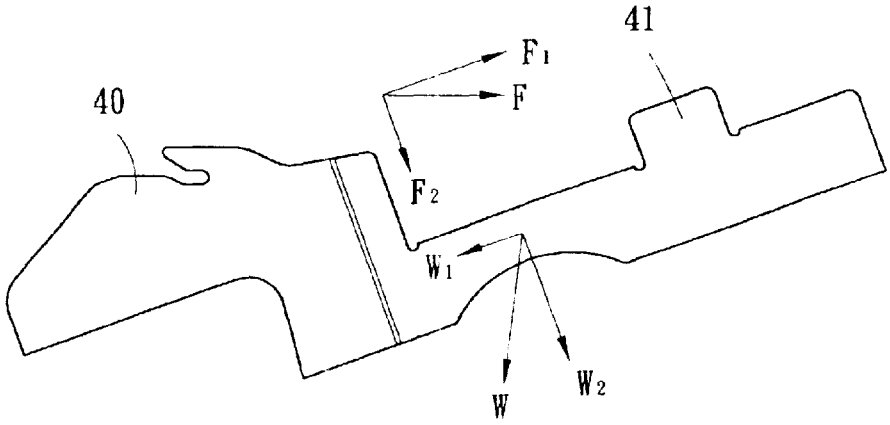
FIG. 10 is a schematic view of force analysis of the sinker of the invention when subject to a dynamic force.

As previously discussed, the saddle plate 10 and the sinker drum 50 are installed in an inclined manner. The cam 20 and the sinker 40 also are mounted thereon in an inclined manner. This is the main feature of the invention to achieve the desired results (referring to FIGS. 9 and 10).

When the sinker drum 50 rotates at high speed, the sinker 40 generates a centrifugal force F (indicated by an arrow in the drawings). As the centrifugal force F applied on the sinker 40 at comprising a horizontal centrifugal component force F1 and a vertical centrifugal component force F2 formed on the inclined surface. The sinker 40 has a gravity force W which also effects a horizontal gravity component force W1 and a vertical gravity component force W2 on the inclined surface. The horizontal gravity component force W1 is opposite to the horizontal centrifugal component force F1 and thus can offset a portion of the horizontal centrifugal component force F1. As a result, the impact force of the lug 41 on the driving path 21 resulting from the centrifugal force F may be reduced. This not only makes moving the lug 41 in the driving path 21 smoother but increases the service life of the sinker 40 and cam 20.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved circular knitting machine for reducing wear to sinkers and cams from centrifugal force, comprising:

a saddle plate having a first inclined surface which has a plurality of holding surfaces formed thereon;

a sinker drum surrounded by the saddle plate having a second inclined surface which has a plurality of sinker troughs formed thereon, the second inclined surface being formed in an annular ring and shaped like a conical shallow tray so that the sinker drum forms a concave surface;

a plurality of sinkers housed in the sinker troughs in an inclined manner; and a plurality of cams each having a fastening section on one end and a contact section on the other end, the contact end having a convex surface in contact with the concave surface of the sinker drum, the contact section having a driving path formed on the bottom side thereof to allow the sinkers to move.

2. The improved circular knitting machine of claim 1, wherein the fastening section of the cam is in contact with the holding surface on a plane.

* * * * *